US006435086B1

(12) United States Patent
Rendleman et al.

(10) Patent No.: US 6,435,086 B1
(45) Date of Patent: Aug. 20, 2002

(54) RETRACTABLE INKING/COATING APPARATUS HAVING FERRIS MOVEMENT BETWEEN PRINTING UNITS

(75) Inventors: Ronald M. Rendleman, Dallas, TX (US); Howard W. DeMoore, 10954 Shady Trail, Dallas, TX (US) 75220; John W. Bird, Carrollton, TX (US)

(73) Assignee: Howard W. DeMoore, Dallas, TX (US)

( * ) Notice: Subject to any disclaimer, the term of this patent is extended or adjusted under 35 U.S.C. 154(b) by 0 days.

(21) Appl. No.: 08/435,798

(22) Filed: May 4, 1995

(51) Int. Cl.[7] ..... B41F 5/16

(52) U.S. Cl. ..... 101/177; 101/185; 101/352.01

(58) Field of Search ..... 101/183, 184, 101/185, 424.1, 350, 363, 351, 352, 247, 136, 141, 350.01, 349.1; 118/46, 212, 258, 259, 261, 262, 217

(56) References Cited

U.S. PATENT DOCUMENTS

| | | | | |
|---|---|---|---|---|
| 2,531,036 A | * 11/1950 | Goettsch | 101/350 X |
| 3,360,393 A | * 12/1967 | Rhorer | 101/363 X |
| 3,397,675 A | 8/1968 | De Ligt | 118/258 |
| 3,433,155 A | 3/1969 | Norton | 101/148 |
| 3,768,438 A | 10/1973 | Kumpf | 118/262 |
| 3,800,743 A | 4/1974 | Egnaczak | 118/259 |
| 3,916,824 A | 11/1975 | Knodel et al. | 118/224 |
| 3,931,791 A | 1/1976 | Preuss et al. | 118/236 |
| 4,222,325 A | 9/1980 | Edwrads | 101/137 |
| 4,270,483 A | 6/1981 | Butler et al. | 118/46 |
| 4,372,244 A | 2/1983 | Rebel | 118/46 |
| 4,397,237 A | 8/1983 | Makosch | 101/352 |
| 4,399,767 A | 8/1983 | Simeth | 118/46 |
| 4,421,027 A | 12/1983 | Fischer | 101/142 |
| 4,446,814 A | 5/1984 | Abendroth | 118/694 |
| 4,501,223 A | 2/1985 | Matsuno et al. | 118/668 |
| 4,524,712 A | 6/1985 | Ito | 118/46 |
| 4,569,306 A | 2/1986 | Ito et al. | 118/249 |
| 4,615,293 A | 10/1986 | Jahn | 118/46 |
| 4,617,865 A | 10/1986 | Switall | 101/350 |
| 4,685,414 A | 8/1987 | DiRico | 118/46 |
| 4,706,601 A | 11/1987 | Jahn | 118/46 |
| 4,779,557 A | 10/1988 | Frazzitta | 118/46 |
| 4,796,556 A | 1/1989 | Bird | 118/46 |
| 4,815,413 A | 3/1989 | Kota | 118/46 |

(List continued on next page.)

FOREIGN PATENT DOCUMENTS

EP 647524 4/1995

OTHER PUBLICATIONS

Papier + Kunststoff Verarbeiter, vol. 26, No. 6, Jun. 1, 1991, p. 129 XP000232825 "Lackier–Aggregat Fuer Speedmaster–Maschinen".

*Primary Examiner*—Eugene Eickholt
(74) *Attorney, Agent, or Firm*—Conley, Rose & Tayon

(57) ABSTRACT

A retractable in-line inking/coating apparatus selectively applies either spot or overall ink/coating to a blanket or flexographic plate on a blanket cylinder or spot coating or overall ink/coating to a flexographic printing plate on a plate cylinder in a rotary offset printing press. The inking/coating apparatus is pivotally mounted on the tower of a printing unit or dedicated coating unit, and is extended into and retracted out of inking/coating engagement by a carriage assembly which is pivotally coupled to the printing unit tower. Because of the pivotal support provided by a cantilevered support arm, the inking/coating apparatus can be raised and lowered through a Ferris wheel arc movement between adjacent printing units. The aqueous component of the printing ink or coating is evaporated by a high velocity, hot air interstation dryer and a high performance heat and moisture extractor so that the ink on a freshly printed sheet is dry before the sheet is printed on the next printing unit. Thus, flexographic ink or coating applied at the first printing unit can immediately be overprinted on subsequent printing units.

8 Claims, 5 Drawing Sheets

U.S. PATENT DOCUMENTS

| | | | | | |
|---|---|---|---|---|---|
| 4,825,804 | A | | 5/1989 | Kirico et al. | 118/46 |
| 4,841,903 | A | | 6/1989 | Bird | 118/46 |
| 4,852,515 | A | | 8/1989 | Terasaka et al. | 118/663 |
| 4,889,051 | A | * | 12/1989 | Sarda | 101/77 |
| 4,934,305 | A | | 6/1990 | Koehler et al. | 118/46 |
| 5,107,790 | A | | 4/1992 | Sliker et al. | 118/674 |
| 5,115,741 | A | * | 5/1992 | Rodi | 101/416.1 |
| 5,176,077 | A | | 1/1993 | DeMoore et al. | 101/232 |
| 5,178,678 | A | | 1/1993 | Koehler et al. | 118/46 |
| 5,209,179 | A | | 5/1993 | Herbert et al. | 118/46 |
| 5,335,596 | A | | 8/1994 | DeMoore | 101/350 |

* cited by examiner

RETRACTABLE INKING/COATING APPARATUS HAVING FERRIS MOVEMENT BETWEEN PRINTING UNITS

FIELD OF THE INVENTION

This invention relates to sheet-fed or web-fed, rotary offset or flexographic printing presses, and more particularly, to a new and improved inking/coating apparatus for the in-line application of printing inks or protective or decorative coatings to sheets or web.

BACKGROUND OF THE INVENTION

Conventional sheet-fed, rotary offset printing presses typically include one or more printing units through which individual sheets are fed and printed with wet ink. After the last printing unit, the sheets are transferred by a delivery conveyor to the delivery end of the press where the freshly printed sheets are collected and stacked. In a typical sheet-fed, rotary offset printing press such as the Heidelberg Speedmaster line of presses, the delivery conveyor includes a pair of endless gripper chains carrying gripper bars and gripper fingers which grip and pull freshly printed sheets from the last impression cylinder and convey the sheets to the sheet delivery stacker.

Since the inks used with rotary offset printing presses typically remain wet and tacky for some time after printing, special precautions must be taken to insure that the freshly printed sheets are not marked or smeared as the sheets are transferred from one printing unit to another, and while being conveyed to the sheet delivery stacker. The printed surface of the sheet dries relatively slowly and can be smeared during subsequent transfer between printing units. In order to reduce smearing and offsetting, spray powder is applied on the printed sheet.

In some printing applications, offset and smearing are prevented by applying a protective and/or decorative coating over all or a portion of the freshly printed sheets. Some coating solutions include varnish, lacquer, dye, moisturizers and ink. Such coatings are formed of a UV-curable or water-dispersed resin applied as a liquid solution or emulsion over the freshly printed sheets to protect the ink and improve the appearance of the freshly printed sheets. Such coatings are particularly desirable when decorative or protective finishes are required such as in the production of posters, record jackets, brochures, magazines, folding cartons and the like. The coating is permeable to oxygen to permit drying of the ink. In cases where a liquid coating is to be applied, the coating operation is carried out after the last color ink has been printed. In some cases, it is desirable to spot coat from the printing plate. For both operations, the coating is most desirably performed by an in-line coater.

In printing presses having flexographic printing plates, an aqueous ink is used, for example metallic (gold) ink and opaque white ink, both of which can be overprinted at the next printing unit. An advantage of flexographic printing is that no dampening unit is required. The flexographic printing plate has a raised image surface (relief). Colors are stronger when flexographic inks are used because they are not diluted by dampening solution.

1. Description of the Prior Art

Various arrangements have been made for applying the coating as an in-line printing operation by using the last printing unit of the press as the coating application unit. For example, in U.S. Pat. Nos. 4,270,483, 4,685,414 and 4,779,557, there are disclosed coating apparatus which can be moved into position to allow the blanket cylinder of the last printing unit of a press to be used to apply a coating material to the sheets. In U.S. Pat. Nos. 4,796,556 and 4,841,903 there is disclosed a coating apparatus which can be selectively moved between the blanket cylinder or the plate cylinder of the last printing unit of the press so that the last printing unit can only be used for coating purposes. However, when coating apparatus of these types are used, the last printing unit cannot be used to apply ink to the sheets, but rather can only be used for the coating operation. Thus, while coating with these types of in-line coating apparatus, the press loses the capability of printing its full range of colors since the last printing unit is converted to a coating unit.

Proposals for overcoming the problem of the loss of a printing unit when in-line coating is desired have also been made, such as that set forth in U.S. Pat. No. 4,934,305 which discloses a coating apparatus having a separately timed applicator roller positioned to apply the coating material to the freshly printed sheet while the sheet is on the last impression cylinder of the press. This is said to allow the last printing unit to print and coat simultaneously, so that no loss of a printing unit capability results. Another approach to providing a coating unit without losing the printing capabilities of the last printing unit is to provide a totally separate coating unit downstream of the last printing unit so that the coating is applied to the sheets after the last printing unit. Such an arrangement is disclosed in U.S. Pat. Nos. 4,399,767, 4,706,601 and 5,176,077.

In an effort to reduce costs and maintain flexibility in adapting the printing press to different jobs, coating apparatus has been provided that can be selectively engaged with the plate cylinder or blanket cylinder to carry out the coating operation, and disengaged so that the last printing unit can be used for offset printing when coating is not required. Examples of coaters which are selectively engagable with either the plate cylinder or the blanket cylinder are disclosed in U.S. Pat. No. 4,615,293 (Jahn), U.S. Pat. No. 5,107,790 (Sliker et al.) and U.S. Pat. No. 4,841,903 (Bird).

The coater of U.S. Pat. No. 4,615,293 includes two applicator rollers, both disposed on the dampening side of the plate cylinder and blanket cylinder for carrying out spot and blanket coating operations as desired. The coater of U.S. Pat. No. 5,107,790 is retractable along an inclined rail for extending and retracting a coater head into engagement with either the plate cylinder or the blanket cylinder. Because of its size, the rail-retractable coater can only be installed between the last printing unit of the press and the delivery stacker, and cannot be used at interstation positions. The coaters of U.S. Pat. No. 4,615,293 are located on the dampener side of the plate and blanket cylinders, thus requiring removal of the dampening unit to make room for the doctor blade head and applicator rollers. Consequently, the last printing unit of the press is converted into a coating unit, resulting in the loss of the printing capability of that printing unit.

It will be appreciated that the time required to reconfigure a press for coating or non-coating is non-productive and costly. Accordingly, there is a need for a coating apparatus which minimizes the time to clean-up from one printing run and set up and run the next job. Where consecutive jobs require the same type of coating, particularly blanket coating, it may not be necessary to clean-up the coater between jobs. However, the coating cannot be allowed to dry on the rollers. Therefore, especially when switching from blanket to spot coating or vice versa, or if there is a delay between jobs, it is necessary to wash-up the coater after each job is completed.

In addition, wash-up is necessary when switching between different coating compositions, such as aqueous and ultra violet (UV) curable coatings. Such coatings are not interchangeable, and the coaters must-be washed between applications of the different coating media. It is difficult to wash-up some coaters while the press is running. Moreover, the retractable coaters mentioned above occupy a large amount of press space and diminishes accessibility to the press. Elaborate equipment is needed for retracting the coater from the operative coating position to an out-of-the-way, inoperative position which reduces access to the printing unit.

A limitation on the use of flexographic printing plates and aqueous printing inks is that the freshly printed or coated sheets require hot air for drying. When applying an aqueous ink such as opaque white or metallic gold, it is necessary to dry the printed sheets between printing units before overprinting them.

Moreover, when utilizing lithographic printing inks, it is necessary to frequently stop the press and wash the blanket. Metallic ink. in particular "piles" on the blanket and must be washed frequently.

2. Objects of the Invention

Accordingly, the principal object of the present invention is to provide improved inking/coating apparatus which is capable of selectively applying ink or a coating material to a plate on a plate cylinder or a coating material to a blanket on a blanket cylinder of a printing press.

Another object of the present invention is to provide inking/coating apparatus of the character described which is extendable into inking/coating engagement with either a plate cylinder or a blanket cylinder, and which is retractable to a non-operative position to provide clear access to the cylinders of the printing unit.

A related object of the present invention is to provide inking/coating apparatus of the character described which is capable of being used in an interstation position and does not interfere with access to the press.

Yet another object of the present invention is to provide inking/coating apparatus of the character described, which can be moved from an operative inking/coating engagement position to a non-operative, retracted position.

Still another object of the present invention is to provide inking/coating apparatus of the character described, which can be used for applying aqueous inks and coatings to a lithographic printing plate or a flexographic printing plate in a rotary offset press.

A related object of the present invention is to provide inking/coating apparatus of the character described, which is capable of applying aqueous coating at, one printing unit and drying the coating before it reaches the next printing unit where it can be overprinted with aqueous ink or lithographic ink.

Another object of the present invention is to provide inking/coating apparatus for use on a multiple color rotary offset printing press that can apply ink or coating to the plate or blanket of a printing unit from a single applicator head.

A related object of the invention is to provide inking/coating apparatus of the character described, in which no printing unit adjustment or alteration is required when the applicator head is converted from plate to blanket operation and vice versa.

SUMMARY OF THE INVENTION

The foregoing objects are achieved by a retractable, in-line inking/coating apparatus which is mounted on a printing unit tower for pivotal, Ferris wheel type movement between an operative inking/coating position and a retracted, overhead position. The inking/coating apparatus includes an applicator head which extends into and retracts out of engagement with a plate on a plate cylinder or a blanket on a blanket cylinder. The inking/coating applicator head is positioned in parallel alignment with either the plate cylinder or the blanket cylinder by a carriage assembly which includes a cantilever support arm. The support arm is pivotally coupled between the inking/coating head and the printing unit tower. This cantilevered, pivotal mounting arrangement allows the inking/coating unit to be used between two printing units, as well as installed on the last printing unit of the press.

In the preferred embodiment, the applicator head includes vertically spaced pairs of cradle members with one cradle pair being adapted for supporting a metal or ceramic coating roller in alignment with a blanket cylinder, and the other cradle pair supporting a resilient anilox coating roller in alignment with the plate cylinder, respectively, when the applicator head is in the operative position. Because of the cantilevered, pivotal support provided by the support arm, the applicator head can be lifted and lowered through an arc, similar to Ferris wheel movement, in the limited space between adjacent printing units. When fully retracted, the coater and carriage assembly are lifted to an overhead position overlying the printing unit tower, thus providing complete access to the printing unit cylinders, without causing the printing unit to lose its printing capability. The inking/coating applicator roller can be inspected, cleaned or replaced and the doctor blade assembly can be washed-up automatically while the inking/coating apparatus is in the fully retracted position.

When the inking/coating apparatus is used in combination with a flexographic printing plate and aqueous ink or aqueous coating, the water component of the aqueous ink or coating on the freshly printed sheet is evaporated by a high velocity, hot air interstation dryer and a high volume heat and moisture extractor assembly so that the freshly printed ink or coating is completely dry before the sheet is printed on the next printing unit. This quick drying flexographic printing/coating arrangement permits a base coat of ink, for example opaque white or metallic ink (gold, silver or other metallics) to be applied in the first printing unit, and then overprinted by the lithographic process on the next printing unit.

Other features and advantages of the present invention will become more apparent from the following detailed description taken in conjunction with the accompanying drawings which disclose, by way of example, the principles of the present invention.

DETAILED DESCRIPTION OF THE PREFERRED EMBODIMENTS

As used herein, the term "processed" refers to various printing methods which may be applied to either side of a substrate, including the application of UV-curable and aqueous inks and/or coatings. The term "substrate" refers to sheet or web material. Also, as used herein, the term "waterless printing plate" refers to a printing plate having non-image surface areas which are hydrophobic and also having image surface areas which are hydrophilic, wherein the non-image surface areas are characterized by a surface tension value which is less than the surface tension of aqueous ink, and the image surface areas are characterized by a surface tension value which is greater than the surface tension of aqueous ink. "Flexographic" refers to flexible printing plates having a relief surface which is wettable by aqueous ink or coating material.

Figure 1:
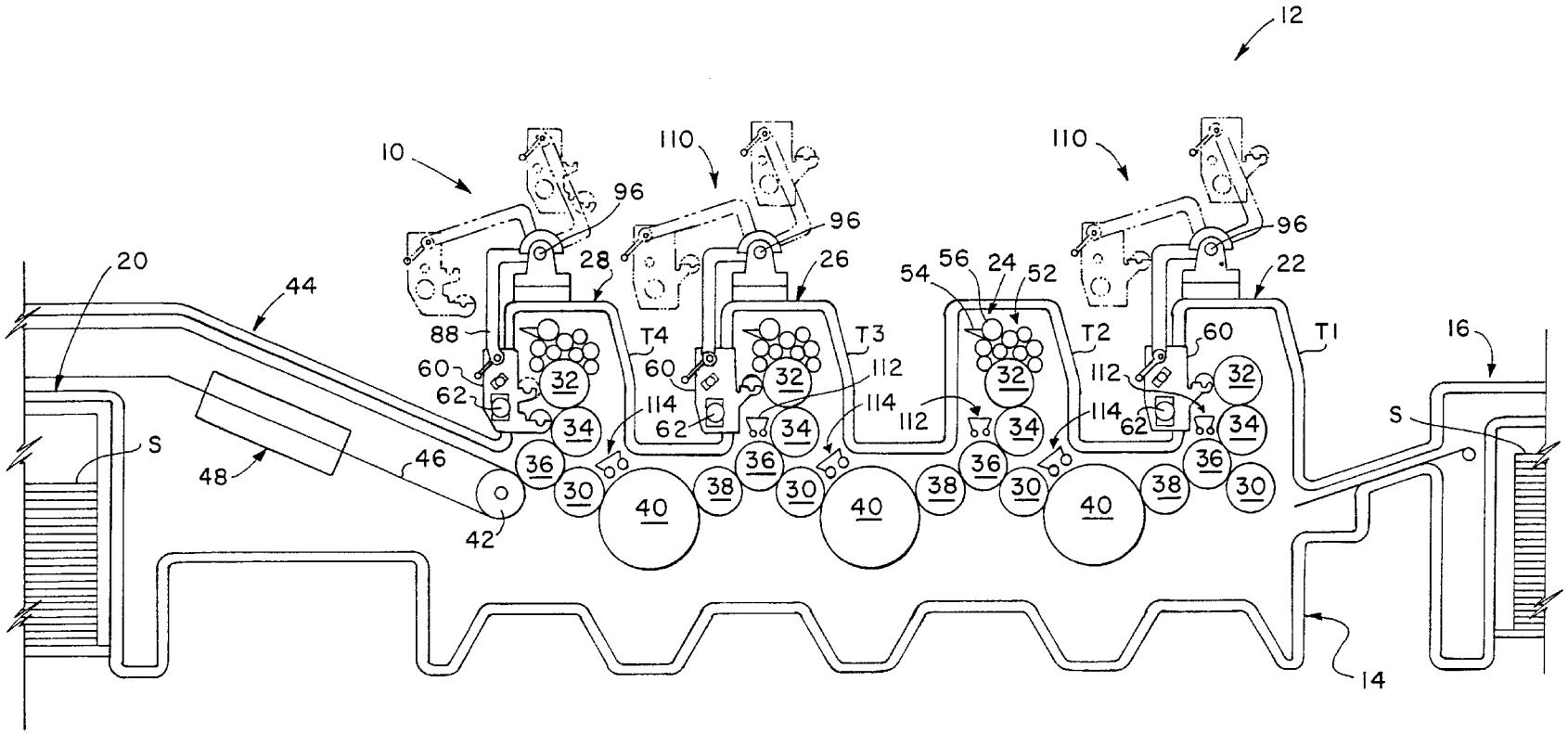
FIG. 1 is a schematic side elevational view of a sheet-fed, rotary offset printing press having inking/coating apparatus embodying the present invention.

As shown in the exemplary drawings, the present invention is embodied in a new and improved in-line inking/coating apparatus, herein generally designated 10, for use in applying inks or protective and/or decorative coatings to sheets or webs printed in a sheet-fed or web-fed, offset rotary or flexographic printing press, herein generally designated 12. In this instance, as shown in FIG. 1, the inking/coating apparatus 10 is installed in a four color printing press 12, such as that manufactured by Heidelberger Druckmaschinen AG of the Federal Republic of Germany under its designation Heidelberg Speedmaster 102V (40"). The press 12 includes a press frame 14 coupled at one end, herein the right end, to a sheet feeder 16 from which sheets, herein designated S, are individually and sequentially fed into the press, and at the opposite end, with a sheet delivery stacker 20 in which the freshly printed sheets are collected and stacked. Interposed between the sheet feeder 16 and the sheet delivery stacker 20 are four substantially identical sheet printing units 22, 24, 26 and 2.8 which can print different color inks onto the sheets as they are transferred through the press 12. The printing units are housed within printing towers T1, T2, T3 and T4 formed by side frame members 14, 15.

As illustrated, the printing units 22, 24, 26 and 28 are substantially identical and of conventional design. The first printing unit 22 includes an in-feed transfer cylinder 30, a plate cylinder 32, a blanker cylinder 34 and an impression cylinder 36, all supported for rotation in parallel alignment between the press side frames 14, 15 which define printing unit towers T1, T2, T3 and T4. Each of the first three printing units 22, 24 and 26 have a transfer cylinder 38,disposed to withdraw the freshly printed sheets from the adjacent impressions cylinder and transfer the freshly printed sheets to the next printing unit via an inter-station transfer cylinder 40. The last printing unit 28 is shown equipped with a delivery cylinder 42 which supports the printed sheet 18 as it is transferred from the last impression cylinder 36 to a delivery conveyor system, generally designated 44, to the sheet delivery stacker 20.

Figure 2:
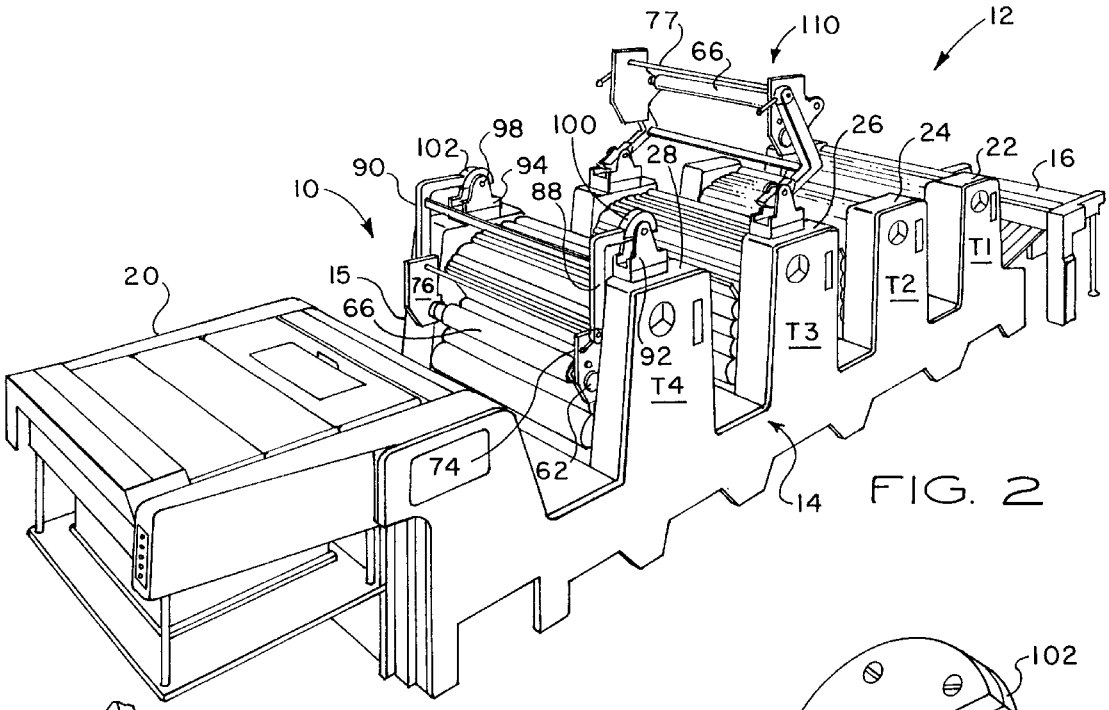
FIG. 2 is a perspective view of the printing press of FIG. 1 in which a dual head inking/coating apparatus is in the operative coating position and a single head coater is in a retracted, overhead position.
Figure 3:
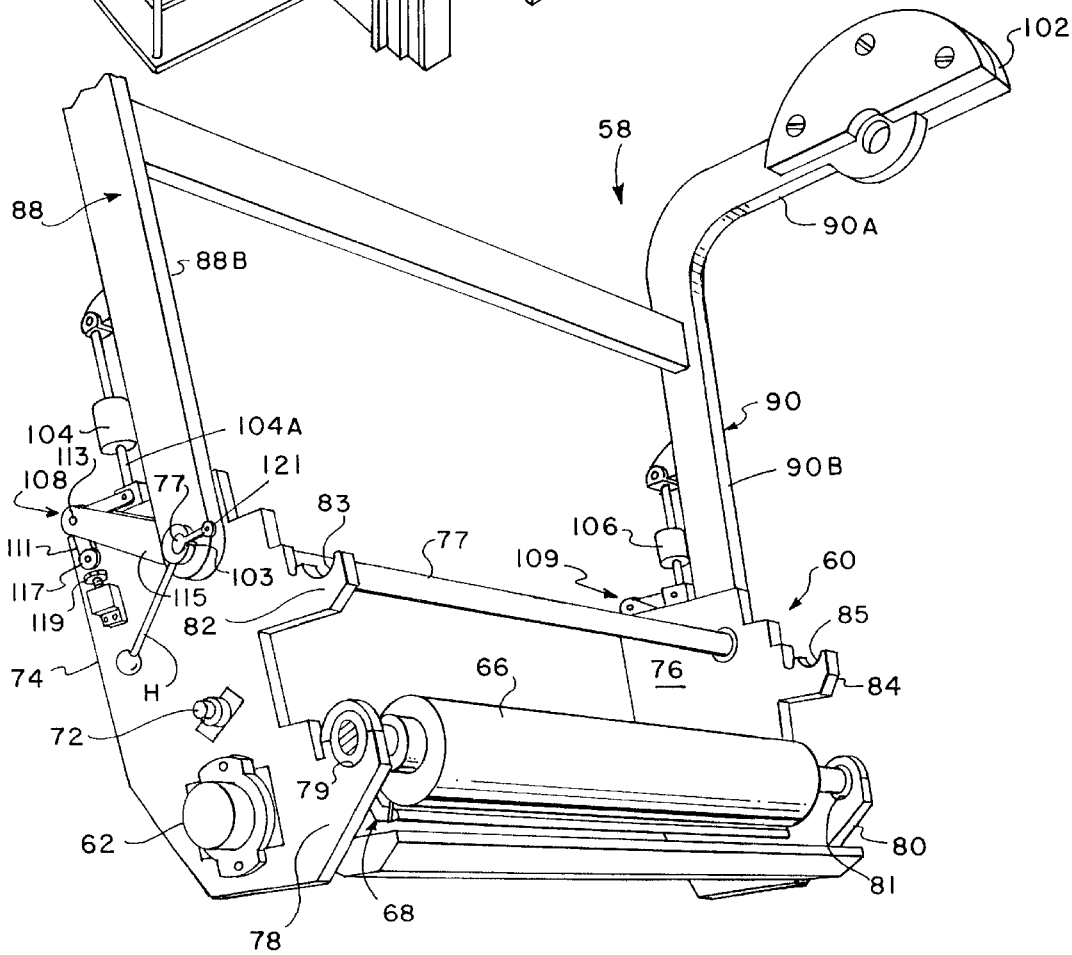
FIG. 3 is an enlarged simplified perspective view showing one side of the single head inking/coating apparatus of FIG. 1 in the operative position.

The delivery conveyor system 44 as shown in FIG. 2 is of conventional design and includes a pair of endless delivery gripper chains 46, only one of which is shown carrying at regular spaced locations along the chains, laterally disposed gripper bars having gripper fingers used to grip the leading edge of a freshly printed sheet 18 after it leaves the nip between the delivery cylinder 42 and impression cylinder 36 of the last printing unit 28. As the leading edge is gripped by the grippers, the delivery chains 46 pull the sheet away from the impression cylinder 36 and convey the freshly printed sheet to the sheet delivery stacker 20.

Prior to reaching the delivery sheet stacker, the freshly printed and/or coated sheets S pass under a delivery dryer 48 which includes a combination of infra-red thermal radiation, high velocity hot air flow and a high performance heat and moisture extractor for drying the ink and/or the protective/decorative coating.

In the exemplary embodiment shown in FIG. 1, the first printing unit 22 is equipped with a flexographic printing plate, and does not require an inking roller train or a dampening system. If an ink roller train is mounted on the first printing unit, the form rollers are retracted and locked off when the printing unit goes on impression. Flexographic aqueous ink is supplied by the inking/coating unit 110. The remaining printing units 24, 26 and 28 are equipped for lithographic printing and include an inking apparatus 50 having an inking roller train 52 arranged to transfer ink from an ink fountain 54 to the plate cylinder 32. This is accomplished with the aid of a fountain roller 56 and a ductor roller. The fountain roller 56 projects into the ink fountain 54, whereupon its surface is wetted with ink. The printing ink Q is transferred intermittently to the inking roller train 52 by the ductor roller. The inking roller train 52 supplies ink Q to the image ares of a printing plate P mounted on the plate cylinder 32.

The printing ink Q is transferred from the printing plate P to an ink receptive blanket B which is mounted on the blanket cylinder 34. The inked image carried on the blanket B is transferred to a sheet S as the sheet is transferred through the nip between the impression cylinder 36 and the blanket B.

The inking roller arrangement 52 illustrated in FIG. 1 is exemplary for use in combination with lithographic ink printing plates. It will be understood that dampening rollers (not illustrated) will be in direct engagement with the lithographic plate P, but are not used in combination with the flexographic plate of printing unit 22.

Figure 4:
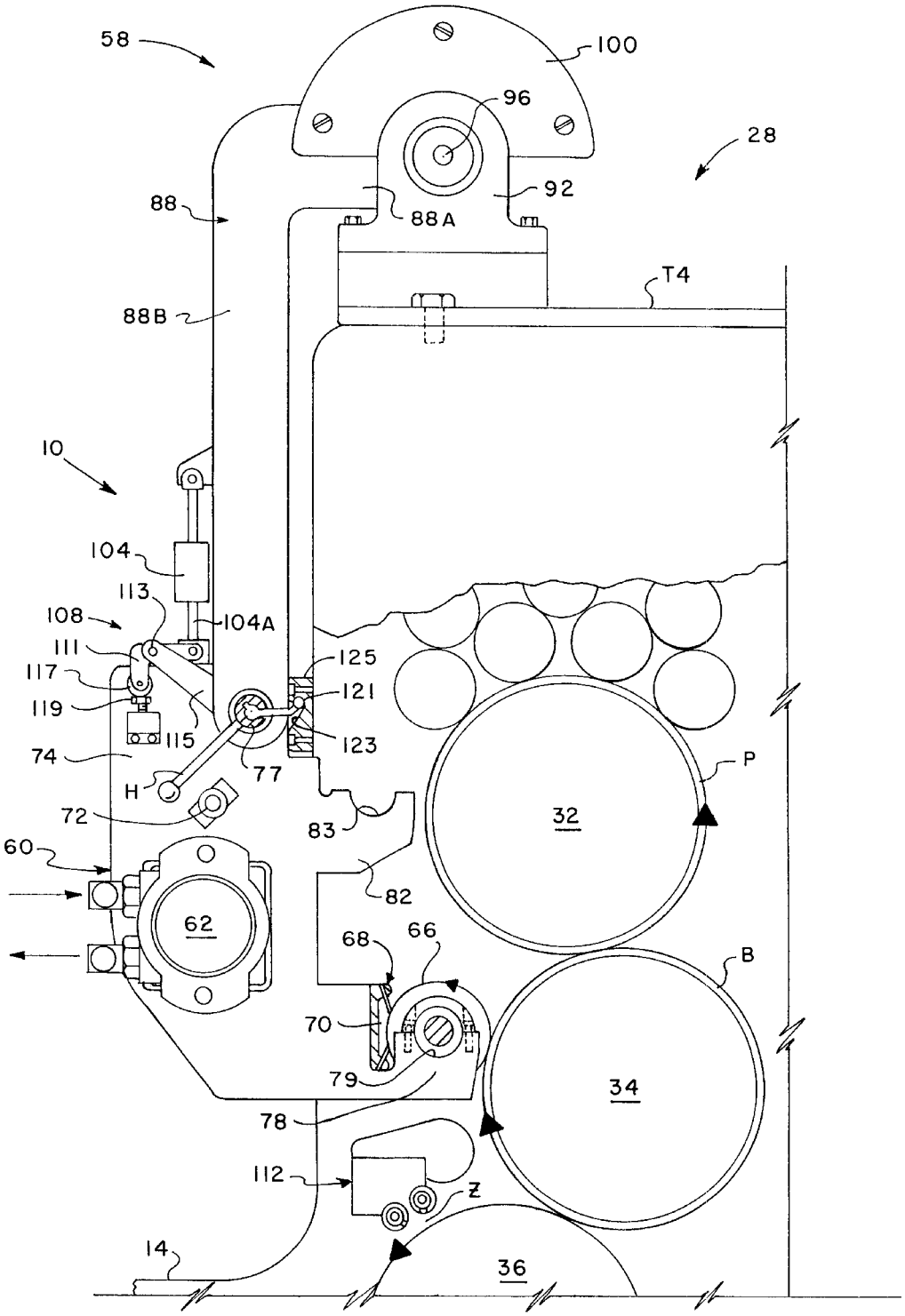
FIG. 4 is a simplified side elevational view showing the dual head inking/coating apparatus in the operative coating position for spot or overall coating from the blanket position.
Figure 5:
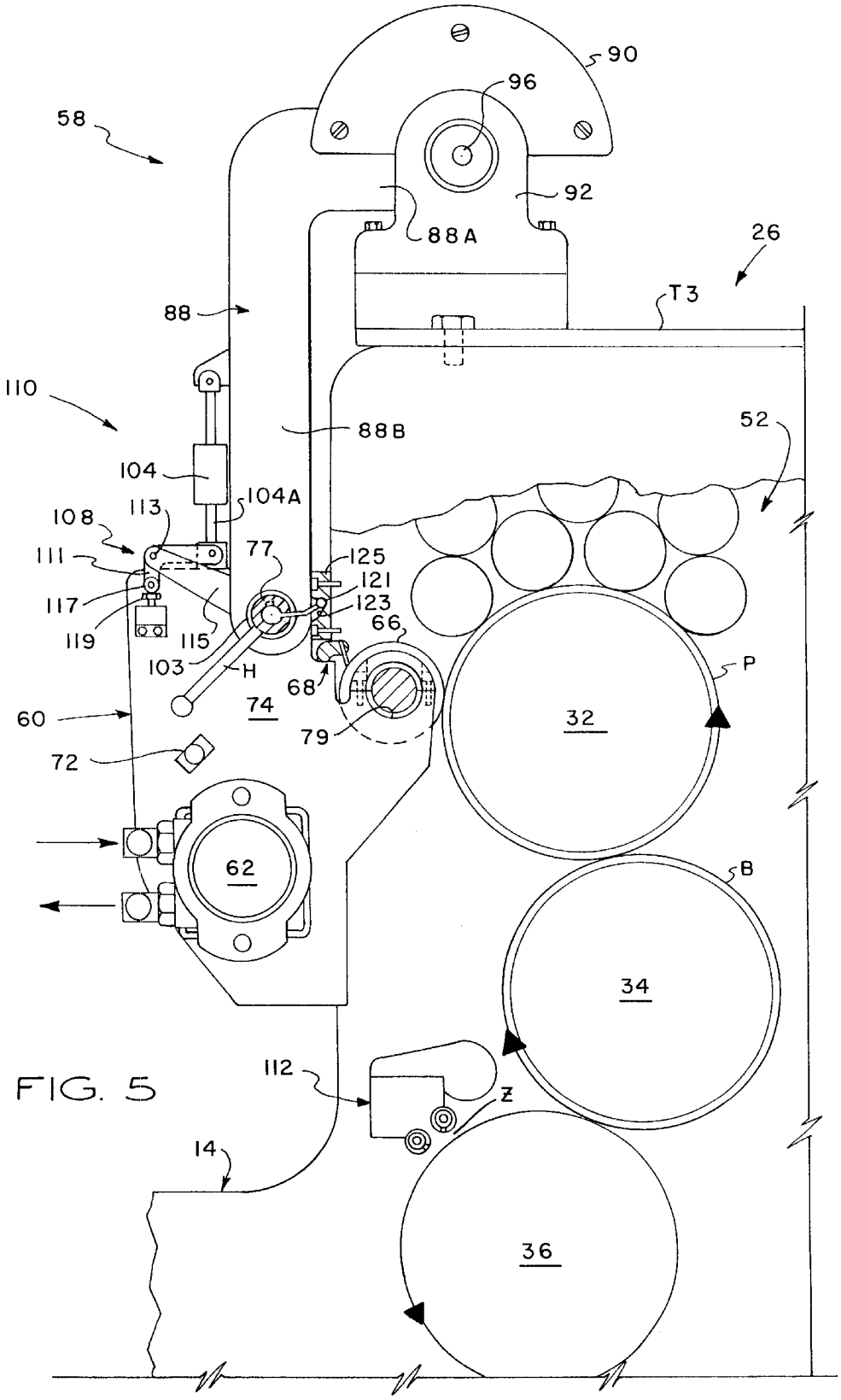
FIG. 5 is a simplified side elevational view showing the single head inking/coating apparatus in the operative coating position for spot or overall coating from the plate position; and, FIG. 6 is a simplified side elevational view of the dual head inking/coating apparatus of FIG. 4, partially broken away, which illustrates the hydraulic drive assembly and doctor blade assembly.
Figure 6:
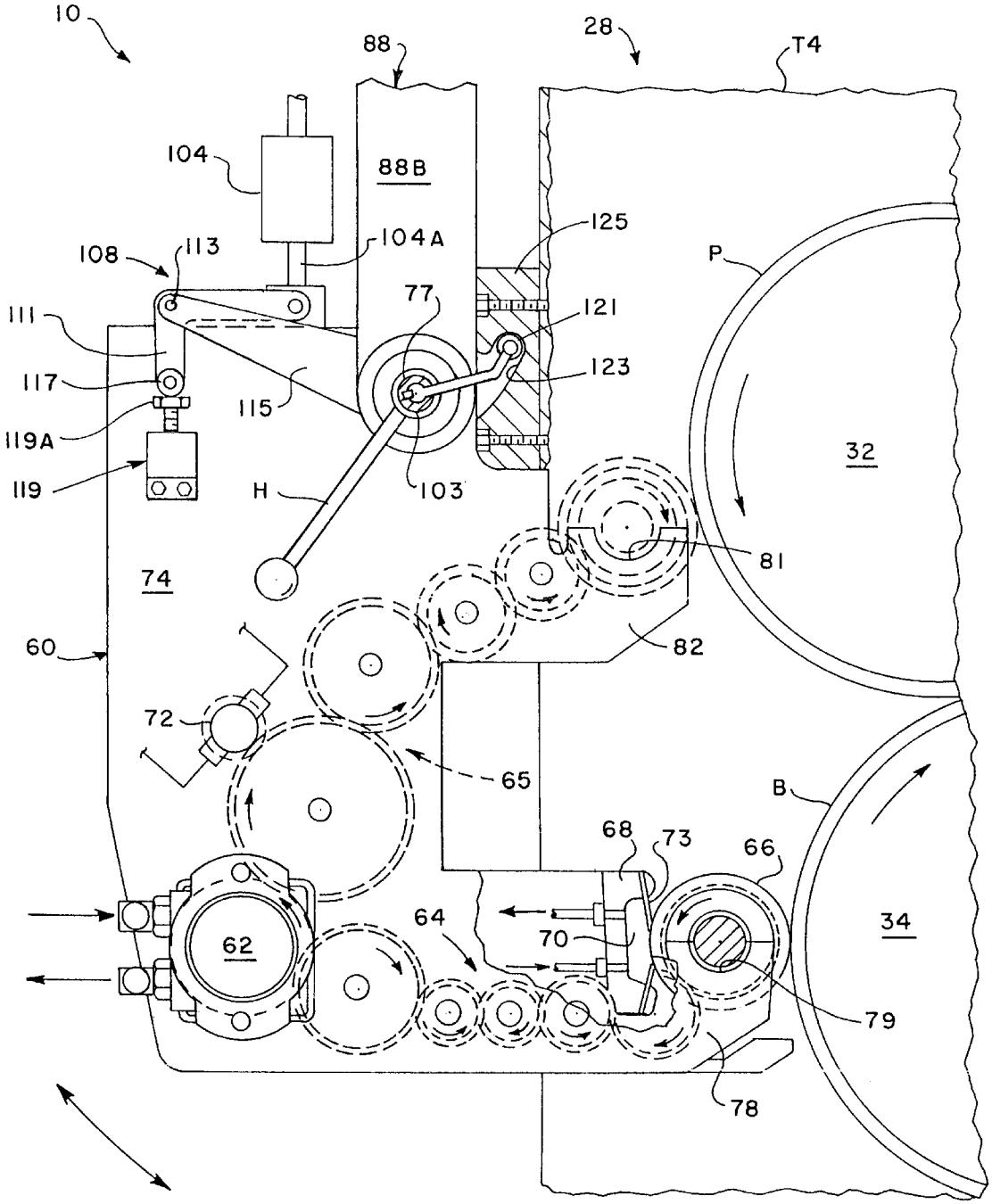

Referring now to FIG. 4, FIG. 5 and FIG. 6, the in-line inking/coating apparatus 10 includes a carriage assembly 58 which supports an applicator head 60. The applicator head 60 includes a hydraulic motor 62, a lower gear train 64, an upper gear train 65, an applicator roller 66 and a doctor blade assembly 68. The external peripheral surface of the applicator roller 66 is inserted into wetting contact with liquid coating material or ink contained in a reservoir 70. The reservoir is continuously supplied with ink or coating which is circulated through the reservoir 70 from an off-press source by a pump (not illustrated). The hydraulic motor 62 drives the applicator roller 66 synchronously with the plate cylinder 32 and the blanket cylinder 34 in response to an RPM control signal from the press drive (not illustrated) and a feedback signal developed by a tachometer 72. While a hydraulic drive motor is preferred, an electric drive motor can be used.

The fluid metering applicator 66 is preferably an anilox roller which transfers measured amounts of printing ink or coating material onto the printing plate or blanket. The surface of an anilox roller is engraved with an array of closely spaced, shallow depressions referred as "cells". Ink or coating from the reservoir 70 flows into the cells as the anilox roller turns through the reservoir. The transfer surface of the anilox roller is scraped with a doctor blade 73 to remove excess ink or coating. The ink or coating remaining on the anilox roller is that contained within the cells.

The anilox roller 66 is cylindrical and may be constructed in various diameters and lengths, containing cells of various sizes and shapes. The volumetric capacity of an anilox roller is established during manufacturing and is dependent upon the selection of cell size, shape and number of cells per unit area. Depending upon the intended application, the cell pattern may be fine (many small cells per square inch) or coarse (fewer larger cells per square inch).

By applying the ink or coating through the inking/coating applicator 60, more ink or coating can be delivered to the sheet S as compared with the inking roller train of a lithographic printing unit. Moreover, color intensity is stronger and more brilliant because the flexographic ink is applied at a much larger film thickness than can be applied by the lithographic process and is not diluted by dampening solution.

Preferably, the doctor blade assembly 68 is constructed as described in U.S. Pat. No. 5,176,077 (DeMoore), which is incorporated herein by reference.

The applicator head 60 includes side frame members 74, 76 which support the applicator roller 66, gear train 64, gear train 65, doctor blade assembly 68 and the drive motor 62. The applicator roller 66 is supported at opposite ends on a lower cradle formed by a pair of end plates 78, 80 which hold the applicator roller 66 in parallel alignment with the blanket cylinder 34 (FIG. 5). The side frame 74, 76 are also provided with an upper cradle formed by a pair of side plates 82, 84 which are vertically spaced with respect to the lower side plates 78, 80. Each cradle has a p air of sockets 79, 81 and 83, 85, respectively, for holding an applicator roller 66 for spot coating or inking engagement against the plate P of the plate cylinder 32 (FIG. 4) or the blanket B of the blanket cylinder 34.

Preferably, the applicator roller 66 for the upper cradle (plate) position is an anilox roller having a resilient transfer surface. In the dual cradle arrangement, the press operator can quickly change over from blanket inking/coating and plate inking/coating with minimum press down time, since it is only necessary to remove and reposition or replace the applicator roller 66, and wash-up the doctor blade assembly if changing from ink to coating or vice versa. The capability to selectively operate in either the flexographic mode or the lithographic mode and to print or coat from either the plate or blanket position is referred to herein as the "LITHOFLEX" process.

According to an important feature of the present invention, the applicator head 60 is supported by the carriage assembly 58 in a cantilevered, pivotal arrangement which allows the dual cradle inking/coating apparatus 10 and single cradle inking/coating apparatus 110 to be installed and used between any two adjacent printing units, as well as installed on the first and last printing units of the press. This is made possible by a pair of cantilevered support arms 88, 90 which are pivotally coupled to the side plates 74, 76, respectively, on a pivot shaft 77. Each support arm has a hub portion 88A, 90A, respectively and an elongated shank portion 88B, 90B, respectively. The elongated shank portion extends transversely with respect to the shank portion, and preferably extend perpendicularly with respect to each other.

The cantilevered support arms are pivotally mounted on the printing tower by pivot blocks 92, 94, respectively. The hub portions 88A, 90A are journalled for rotation on pivot shafts 96, 98, respectively. The pivot blocks 92, 94 are securely fastened to the tower 14D, so that the carriage assembly 86 is pivotally suspended from the pivot shafts 96, 98 in a cantilevered Ferris support arrangement. The shank portions 88B, 90B are pivotally coupled to the pivot shaft 77, so that the carriage assembly 58 and the applicator head 60 are capable of independent rotation with respect to each and with respect to the pivot shaft 77. By this arrangement, the applicator head 60 is pivotally suspended from the pivot shaft 77, and remains in an upright orientation as the support arms rotate from the operative position to the fully retracted position and vice versa.

Thus, the cradles 78, 80 and 82, 84 position the applicator roller 66 in vertical and horizontal alignment with the plate cylinder or blanket cylinder when the applicator head is extended to the operative position. Moreover, because of the transverse relationship between the hub portion and shank portion of the support arms, the applicator head 60 and carriage assembly 58 are capable of rotating through a Ferris arc without touching the adjacent tower. This makes it possible to install the inking/coating apparatus 10 on any intermediate printing unit tower (T2, T3), and as well as the first printing unit tower T1 and the last printing unit tower T4. Additionally, because of the transverse relationship of the support arm hub portion and shank portion, the lateral projection of the applicator head 60 into the interstation space between printing units is minimized, thus assuring virtually unrestricted operator access in the interstation space between adjacent printing units when the applicator head is engaged in the operative position, and completely unrestricted access when the applicator head is completely retracted.

As shown in FIG. 1 and FIG. 2, rotation of the carriage assembly 58 is counterclockwise from the retracted position (shown in phantom) to the operative position. The carriage assembly can be adapted for clockwise rotation from the retracted position to the operative position for engagement of the applicator roller to either the plate cylinder or the blanket cylinder on the dampener side of the tower, assuming that access to the plate and blanket is not restricted by dampener rollers or the like.

Rotational movement of the support arms 88, 90 is assisted by counterweights 100, 102 which are secured to the support arms, respectively, for concurrent rotation with respect to the pivot blocks 92, 94. With the passive assistance of the counterweights, the press operator can easily move the inking/coating assembly 10 from the engaged operative position as shown in FIG. 4 to the fully retracted idle position as shown in phantom in FIG. 1. Preferably, rotation of the carriage assembly 58 is assisted by power means such as a torsion spring, electric motor, or hydraulic motor.

The inking/coating apparatus 10 is releasably locked into the engaged position as shown in FIG. 4 by releasable latch couplings 103, 105 which secure the support arms 88, 90 to the press side frames 14, 15, respectively, of the printing unit tower T4 in the operative position. Coating engagement of the applicator roller 66 against the blanket cylinder 34 is produced by power actuators, preferably pneumatic cylinders 104, 106 which have extendable/retractable power transfer arms 104A, 106A, respectively. The pneumatic cylinder 104 is pivotally coupled to the support arm 88 by a pivot linkage 108, and the second pneumatic cylinder 106 is pivotally coupled to the support arm 90 by a pivot linkage 109. In response to actuation of the pneumatic cylinders 104, 106, the power transfer arms are retracted. As the arms retract, the inking/coating head 60 is rotated counterclockwise on the pivot shaft 77, thus moving the applicator roller 66 into coating engagement with the blanket cylinder 34.

The pivot linkage 108 includes a bell crank 111 which is mounted for pivotal movement on a pin 113. The pin 113 is supported by a clevis plate 115 which is attached to the support arm 88. One end of the bell crank is pivotally coupled to the actuator arm 104A, and a cam roller 117 is mounted for rotation on its opposite end.

The cam roller 117 is engagable against an adjustable stop 119 which is rigidly secured to the side plate 74. Counterclockwise shifting of the handle H moves a cam follower 121 into a latch pocket 123 of a receiver block 125 as the cam roller 117 is moved into engagement with the adjustable stop 119 in the interlocked, operative position. Referring to FIG. 4, FIG. 5 and FIG. 6, the receiver block is rigidly secured to the delivery side face of the printing unit tower by machine screws.

When the plate P goes on impression, power is applied to the pneumatic actuator 104 and the power transfer arm 104A retracts, thus causing the bell crank 111 to rotate counterclockwise about the pin 113. The torque applied by the actuator is transmitted to the applicator head 60 through the cam roller 117 and the adjustable stop 119. Counterclockwise movement of the applicator head 60 relative to the support shaft 77 carries the applicator roller 66 into engagement with the plate P.

The adjustable stop 119 has a threaded bolt 119A which is engagable with the cam roller 117. The striking point of engagement is preset so that the applicator roller 66 is properly positioned for engagement with the plate P or blanket B when the applicator head 60 is interlocked with the press frame 14 and the printing unit goes on impression.

Referring to FIG. 5, an inking/coating apparatus 110 having a single head is illustrated. The construction of this alternative embodiment is identical in all respects with the dual head arrangement, with the exception that only a single gear train and a single cradle for holding the applicator roller is provided. In both embodiments, the inking/coating head 60 remains upright as it swings through an arc, similar to the movement of a Ferris wheel. Because of the upright orientation of the inking/coating head 60 as it moves between the extended and retracted positions, the usual platform spacing between printing unit towers provides adequate clearance to permit extension and retraction of the carriage assembly 58 without interference with operator access to the printing units. This is a significant advantage in that it permits the in-line inking/coating apparatus to operate effectively in the interstation space between any adjacent printing units, and without blocking or obstructing access to the cylinders of the printing units when the inking/coating apparatus is in the fully retracted position as indicated in FIG. 1.

Moreover, when the in-line inking/coating apparatus is in the fully retracted position, the applicator roller 66 is conveniently positioned on the dampener side-of the printing unit for inspection, clean-up or removal. Additionally, the doctor blade assembly is also conveniently positioned for inspection, removal, adjustment or clean-up. The doctor blade reservoir and coating circulation lines can also be cleaned while the printing unit is running as well as when the press has been stopped for change-over from one type of ink or coating to another.

When the inking/coating apparatus is used for applying an aqueous ink or an aqueous coating material, the water component on the freshly printed sheet S is evaporated by a high velocity, hot air interstation dryer and high volume heat and moisture extractor units 112 and 114, as shown in FIG. 1, FIG. 4 and FIG. 5. The dryer/extractor units 112 and 114 are oriented to direct high velocity heated air onto the freshly printed/coated sheet as it is transferred by the impression cylinder 36 and the intermediate transfer cylinder 40. By this arrangement, the freshly printed aqueous ink or coating is completely dry before the sheet is overprinted in the next printing unit.

The high velocity, hot air dryer and high performance heat and moisture extractor units 112, 114 utilize high velocity air jets which scrub and break-up the moist air level which clings to the surface of each freshly printed sheet. Within each dryer, high velocity air is heated to a high temperature as it flows across a resistance heating element within an air delivery baffle tube. High velocity jets of hot air are discharged through multiple airflow apertures through an exposure zone Z (FIG. 4 and FIG. 5) onto the freshly printed/coated sheet S as it is transferred by the impression cylinder 36 and transfer cylinder 40, respectively. Each dryer assembly includes a pair of air delivery dryer heads which are arranged in spaced, side-by-side relation. The high velocity, hot air dryer and high performance heat and moisture extractor units 112, 114 are preferably constructed as disclosed in co-pending U.S. patent application Ser. No. 08/132,584, filed Oct. 6, 1993, entitled "High Velocity Hot Air Dryer", assigned to the assignee of the present invention and which is incorporated herein by reference.

The high velocity, hot moisture-laden air displaced from each printed sheet is extracted from the dryer exposure zone Z and completely exhausted from the printing unit by the high volume extractors. Each extractor head includes a manifold coupled to the dryer heads and draws the moisture, volatiles and high velocity hot air through a longitudinal gap between the dryer heads. According to this arrangement, each printed sheet is dried before it is run through the next printing unit.

The water-based inks used in flexographic printing dry at a relatively moderate drying temperature provided by the interstation high velocity hot air dryers/extractors 112, 114. Because each freshly printed sheet is dried between each printing unit, clarity and print quality are substantially improved since the aqueous ink is dried at each printing unit before it enters the next printing unit. Since the aqueous ink is dry before the sheet enters the next printing unit, back-trapping on the blanket of the next printing unit is completely eliminated. This interstation drying arrangement makes it possible to print aqueous inks such as metallic ink and opaque white ink at one printing unit, and then overprint at the next printing unit.

Moreover, this arrangement permits the first printing unit to be used as a coater in which an aqueous coating is applied to low grade paper such as recycled paper to trap and seal in lint, dust, spray powder and other debris and provide a smoother, durable surface which is overprinted in the next printing unit. An UV-curable coating can be applied over the first down over-printed (aqueous) coating in the last printing unit. The first down layer seals the surface of the low grade, rough substrate and improves overprinted dot definition while preventing strike-through and show-through.

Preferably, the applicator roller 66 is either metal or ceramic when it is used for applying a coating material to the blanket B on the cylinder 34. When the applicator roller 66 is applied to the plate, it is preferably constructed as an anilox roller having a resilient transfer surface for engaging a flexographic printing-plate. Suitable resilient roller surface materials include Buna N synthetic rubber and EPDM (terpolymer elastomer).

It will be appreciated that the inking/coating apparatus 10 is capable of applying a wide range of ink types, including fluorescent (Day Glo), pearlescent, metallics (gold, silver and other metallics), glitter, scratch and sniff (micro-encapsulated fragrance), scratch and reveal, luminous, pressure-sensitive adhesives and the like.

The press operator can eliminate the dampener roller assembly altogether, and the inking/coating apparatus 10 can selectively apply aqueous inks and coatings to a flexographic or waterless printing plate and the blanket. Moreover, overprinting of the aqueous inks and coatings can be carried out in the next printing unit since the aqueous inks and coatings are completely dried by the high velocity, hot air interstation dryer and high volume heat and moisture extractor assembly of the present invention.

The aqueous inks and coatings as used in the present invention contain colored pigments and/or soluble dyes, binders which fix the pigments onto the surface of the printed sheet and waxes, defoamers and thickeners. Aqueous printing inks predominantly contain water as a solvent, diluent and/or vehicle. The thickeners which are preferred include algonates, starch, cellulose and its derivatives, for example cellulose esters or cellulose ethers and the like. Coloring agents including organic as well as inorganic pigments may be derived from dyes which are insoluble in water. Also, the printing ink may contain water and may be predominantly glycol or the like, with the pigment being bound by an appropriate resin. When metallic inks are printed, the cells of the anilox roller must be appropriately sized to prevent the metal particles from getting stuck within the cells. The cell size is critical, and for metallic gold ink, the anilox roller should have a screen line count in the range of 175–300 lines per inch.

The inking/coating apparatus 10 can also apply UV-curable inks and coatings. If UV-curable inks and coatings are utilized, ultra-violet dryers/extractors are installed adjacent the high velocity hot air dryer/extractor units 112, 114, respectively.

Moreover, by utilizing the coating apparatus on the first printing unit, a seal coating can be applied to trap lint, spray powder, dust and other debris, and cover defects on lower grade paper which will improve print quality, which can then be overprinted on the next in-line printing unit.

It will be appreciated that the "LITHOFLEX" system described herein makes it possible to selectively operate a printing unit in either the flexographic printing mode or the lithographic printing mode, while also providing the capability to print or coat from either the plate or blanket position. The dual cradle support arrangement of the present invention makes it possible to quickly change over from inking/coating at the blanket cylinder position to inking/coating at the plate cylinder position with minimum press down-time, since it is only necessary to remove and reposition or replace the applicator roller 66 while the printing/inking apparatus is in the retracted position.

Moreover, the press operator may elect to spot or overall coat with aqueous ink/coating from the plate for one job, and then spot and/or overall coat from the blanket during the next job. Since the doctor blade assembly can be flushed and washed-up quickly and the applicator roller can be changed out quickly, it is possible to spot coat or overall coat from the plate position or the blanket position with aqueous inks or coatings during the first press run and then spot coat or overall coat with UV-curable inks or coatings from the plate position or from the blanket position during the next press run. The inking/coating apparatus is completely out of the way in the retracted position; consequently, the doctor blade reservoir and supply lines may be flushed and washed-up by automatic wash-up equipment while the printing unit is printing another job.

The positioning of the applicator head and roller assembly relative to the plate and blanket is repeatable to a predetermined, preset impression position. Consequently, no printing unit adjustment or alteration is required, except for flushing the doctor blade assembly and cleaning or replacing the applicator roller to accommodate a different kind of ink or coating. Although manual extension and retraction have been described in connection with the exemplary embodiment, extension to the operative position and retraction to a non-operative position can be carried out automatically by hydraulic or electric motor servomechanisms.

The cantilevered, Ferris wheel support arrangement allows the inking/coating apparatus to operate effectively in the interstation space between any adjacent printing units, as well as on the first or last printing units of the press, without blocking or obstructing the interstation space or restricting operator access to the cylinders of any of the printing units.

Finally, because the inking/coating apparatus of the present invention is mounted on a printing unit tower and is extendable to the operative position without requiring adjustment or alteration of the printing unit cylinders, it can be used for applying ink or coating to the blanket cylinder of a rotary offset web press, or to the blanket of a dedicated coating unit.

Although the present invention and its advantages have been described in detail, it should be understood that various changes, substitutions and alterations may be made herein without departing from the spirit and scope of the present invention as defined by the appended claims.

What is claimed is:

1. In a printing press of the type having side frame members forming a printing unit tower on which a plate cylinder and blanket cylinder are supported for rotation, the improvement comprising:

inking/coating apparatus for applying ink or coating material directly to a plate mounted on the plate cylinder or directly to a blanket mounted on the blanket cylinder when the inking/coating apparatus is in an operative position; and a carriage assembly including a support arm having a first end portion including a counterweight coupled to the support arm, pivotally mounted to the printing unit tower and a second end portion pivotally mounted to the inking/coating apparatus, the carriage assembly being movable to an operative position in which the inking/coating apparatus is suspended laterally adjacent to the plate and blanket cylinders, and being movable to a retracted position in which the inking/coating apparatus is elevated with respect to the plate and blanket cylinders.

2. In a printing press of the type having side frame members forming a printing unit tower on which a plate cylinder and blanket cylinder are supported for rotation, the improvement comprising:

inking/coating apparatus for applying ink or coating material to a plate mounted on the plate cylinder or to a blanket mounted on the blanket cylinder when the inking/coating apparatus is in an operative position;

a carriage assembly including a support arm having a first end portion pivotally mounted to the printing unit tower and a second end portion pivotally mounted to the inking/coating apparatus, the carriage assembly being movable to an operative position in which the inking/coating apparatus is suspended laterally adjacent to the plate and blanket cylinders, and being movable to a retracted position in which the inking/coating apparatus is elevated with respect to the plate and blanket cylinders;

a power actuator pivotally coupled to the support arm, the power actuator having a power transfer arm which is extendable and retractable;

apparatus coupled to the power transfer arm for converting extension or retraction movement of the power transfer arm into pivotal movement of the inking/coating apparatus relative to the support arm;

the movement converting apparatus comprising:

a bell crank plate having a first end portion coupled to the power transfer arm and having a second end portion for engaging a stop member;

a stop member secured to the inking/coating apparatus; and a cleavis plate secured to the support arm and pivotally coupled to the bell crank plate.

3. In a printing press of the type having side frame members forming a printing unit tower on which a plate cylinder and blanket cylinder are supported for rotation, the improvement comprising:

inking/coating apparatus for applying ink or coating material to a plate mounted on the plate cylinder or to a blanket mounted on the blanket cylinder when the inking/coating apparatus is in an operative position;

a carriage assembly including a support arm having a first end portion pivotally mounted to the printing unit tower and a second end portion pivotally mounted to the inking/coating apparatus, the carriage assembly being movable to an operative position in which the inking/coating apparatus is suspended laterally adjacent to the plate and blanket cylinders, and being movable to a retracted position in which the inking/coating apparatus is elevated with respect to the plate and blanket cylinders;

the inking/coating apparatus comprising:

an applicator heading having first and second side frame members pivotally coupled to the carriage assembly;

a doctor blade assembly mounted between the first and second side frame members, the doctor blade assembly including a reservoir for receiving ink or liquid coating material;

cradle means mounted on the first and second side frame members, respectively;

an applicator roller mounted for rotation on the cradle means and coupled to the doctor blade assembly for rolling contact with the ink or coating material in the reservoir, the applicator roller being engageable with a printing plate on the plate cylinder or with a blanket on the blanket cylinder in the operative position; and motor means coupled to the applicator roller for rotating the applicator roller;

the cradle means including first and second sockets disposed on the first and second side frame members, respectively, and third and fourth sockets disposed on the first and second side frame members, respectively;

the applicator roller being mountable for rotation on the first and second sockets for applying ink or coating material to the plate when the carriage assembly is in the operative position; and the applicator roller being mountable for rotation on the third and fourth sockets for applying ink or coating material to the blanket when the carriage assembly is in the operative position.

4. In a printing press of the type having side frame members forming a tower on which a blanket cylinder is supported for rotation, the improvement comprising:

inking/coating apparatus for applying ink or coating material to a blanket mounted on the blanket cylinder when the inking/coating apparatus is in an operative position; and a carriage assembly pivotally mounted to the tower and to the inking/coating apparatus, said carriage assembly movable between an operative position and a retracted position, said inking/coating apparatus pivoting relative the carriage assembly as the carriage assembly is moved between the operative position and retracted position to maintain a relatively constant orientation to the horizontal, the inking/coating apparatus in direct contact with the blanket cylinder in the operative position and elevated with respect to the blanket cylinder in the retracted position.

5. The invention as set forth in claim 4, further comprising:

a power actuator pivotally coupled to the support arm, the power actuator having a power transfer arm which is extendable and retractable; and, apparatus coupled to the power transfer arm for converting extension or retraction movement of the power transfer arm into pivotal movement of the inking/coating apparatus relative to the common pivot shaft.

6. In a printing press of the type having side frame members forming a tower on which a blanket cylinder is supported for rotation, the improvement comprising:

inking/coating apparatus for applying ink or coating material to a blanket mounted on the blanket cylinder when the inking/coating apparatus is in an operative position;

a carriage assembly pivotally mounted to the tower and to the inking/coating apparatus, said carriage assembly movable between an operative position and a retracted position, said inking/coating apparatus pivoting relative the carriage assembly as the carriage assembly is moved between the operative position and retracted position to maintain a relatively constant orientation to the horizontal;

the tower including a plate cylinder and a plate mounted on the plate cylinder, the inking/coating apparatus including:

first cradle means for supporting an applicator roller for engagement against the plate when the inking/coating apparatus is in the operative position; and second cradle means for supporting an applicator roller for engagement against the blanket when the inking/coating apparatus is in the operative position.

7. In a printing press of the type having side frame members forming a tower on which a blanket cylinder is supported for rotation, the improvement comprising:

inking/coating apparatus for applying ink or coating material to a blanket mounted on the blanket cylinder when the inking/coating apparatus is in an operative position;

a carriage assembly pivotally mounted to the tower and to the inking/coating apparatus, said carriage assembly movable between an operative position and a retracted position, said inking/coating apparatus pivoting relative the carriage assembly as the carriage assembly is moved between the operative position and retracted position to maintain a relatively constant orientation to the horizontal;

said carriage assembly including a support arm having a first end portion pivotally coupled to the tower and having a second end portion;

a common pivot shaft on which the support arm second end portion and the inking/coating apparatus are pivotally mounted; and male and female latch members coupled between the common pivot shaft and the tower, with one of the latch members being secured to the common pivot shaft and the other latch member being secured to the tower, the latch members being mateable in interlocking engagement when the inking/coating apparatus is in the operative position.

8. In a printing press of the type having side frame members forming a tower on which a blanket cylinder is supported for rotation, the improvement comprising:

inking/coating apparatus for applying ink or coating material to a blanket mounted on the blanket cylinder when the inking/coating apparatus is in an operative position;

a carriage assembly pivotally mounted to the tower and to the inking/coating apparatus, said carriage assembly movable between an operative position and a retracted position, said inking/coating apparatus pivoting relative the carriage assembly as the carriage assembly is moved between the operative position and retracted position to maintain a relatively constant orientation to the horizontal;

a power actuator pivotally coupled to the support arm, the power actuator having a power transfer arm which is extendable and retractable;

apparatus coupled to the power transfer arm for converting extension or retraction movement of the power transfer arm into pivotal movement of the inking/coating apparatus relative to the common pivot shaft;

the movement converting apparatus comprising:

a bell crank plate having a first end portion coupled to the power transfer arm and having a second end portion for engaging a stop member;

a stop member secured to the inking/coating apparatus; and a cleavis plate secured to the support arm and pivotally coupled to the bell crank plate.

* * * * *